US012428215B1

(12) United States Patent
Weiss et al.

(10) Patent No.: US 12,428,215 B1
(45) Date of Patent: Sep. 30, 2025

(54) PACKAGING FOR GOLF CLUBS

(71) Applicant: Topgolf Callaway Brands Corp., Carlsbad, CA (US)

(72) Inventors: Erik Weiss, Carlsbad, CA (US); Fred Stenson, Carlsbad, CA (US)

(73) Assignee: Topgolf Callaway Brands Corp., Carlsbad, CA (US)

( * ) Notice: Subject to any disclaimer, the term of this patent is extended or adjusted under 35 U.S.C. 154(b) by 381 days.

(21) Appl. No.: 18/115,605

(22) Filed: Feb. 28, 2023

Related U.S. Application Data

(60) Provisional application No. 63/317,824, filed on Mar. 8, 2022.

(51) Int. Cl.
*B65D 85/20* (2006.01)
*A63B 53/04* (2015.01)

(52) U.S. Cl.
CPC ..... *B65D 85/20* (2013.01); *A63B 53/047* (2013.01); *B65D 2585/08* (2013.01)

(58) Field of Classification Search
CPC ..... B65D 85/20; B65D 2585/08
USPC ..... 206/443; 229/120.02, 120.06, 120.08, 229/120.13, 120.14, 120.29, 120.38
See application file for complete search history.

(56) References Cited

U.S. PATENT DOCUMENTS

| | | | | |
|---|---|---|---|---|
| 2,604,255 | A * | 7/1952 | Welshenbach | A63B 55/40 229/923 |
| 4,887,817 | A | 12/1989 | Pelc | |
| 5,971,265 | A | 10/1999 | Collins | |
| 6,059,180 | A | 5/2000 | Collins | |
| 9,120,593 | B2 | 9/2015 | Mena et al. | |
| 10,233,005 | B1 | 3/2019 | De Bonet | |
| 10,251,503 | B1 | 4/2019 | Fulps | |
| 11,161,646 | B1 | 11/2021 | Parrish et al. | |
| 2020/0207506 | A1 | 7/2020 | Lopez Masague | |

* cited by examiner

*Primary Examiner* — Javier A Pagan
(74) *Attorney, Agent, or Firm* — Michael A. Catania

(57) ABSTRACT

A packaging box for golf clubs is disclosed herein. The box comprises a body comprising a plurality of walls defining an elongated hollow interior, and divider inserts. The divider inserts allow for iron-type golf clubs to be packaged without the need for a full length plastic bag.

6 Claims, 15 Drawing Sheets

PACKAGING FOR GOLF CLUBS

CROSS REFERENCE TO RELATED APPLICATION

The present application claims priority to U.S. Patent Application No. 63/317,824, filed on Mar. 8, 2022, which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention generally relates to packaging for golf clubs. More specifically, the present invention relates to packaging for iron-type golf clubs.

Description of the Related Art

The prior art discloses various boxes for golf clubs.

Collins, U.S. Pat. No. 5,971,265 discloses a paperboard box for shipping elongated items such as golf clubs, wherein the box provides protection from bending moments applied to the length of the container.

Collins, U.S. Pat. No. 6,059,180 discloses a paperboard box for shipping elongated items such as golf clubs, wherein the box provides dividers to separate the contents of the box.

Mena et al., U.S. Pat. No. 9,120,593 discloses a paperboard box with integrated collapsible dividers.

De Bonet, U.S. Pat. No. 10,233,005 discloses air padded containers for shipping golf clubs.

Parrish et al., U.S. Pat. No. 11,161,646 discloses a box with an interior lift mechanism for displaying goods stored within the box.

Current boxes for irons require that each iron of a set be placed within a plastic bag to prevent damage to the club.

BRIEF SUMMARY OF THE INVENTION

The present invention provides a box for iron-type golf clubs that does not require full length plastic bags for the golf clubs.

One aspect of the present invention is a box for a set of iron-type golf clubs. The box comprises a body comprising a plurality of walls defining an elongated hollow interior, and separator panels. A first separator panel extends less than halfway along a long axis of the body from a first end of the body. The first separator panel is positioned midway between a width of the elongated hollow interior of body. The second separator panel extends less than halfway along a long axis of the body from a second end of the body. The second end opposes the first end. The second separator panel is positioned midway between the width of the elongated hollow interior of body. A plurality of iron-type golf clubs is positioned within the elongated hollow interior and separated by the first separator panel and the second separator panel.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
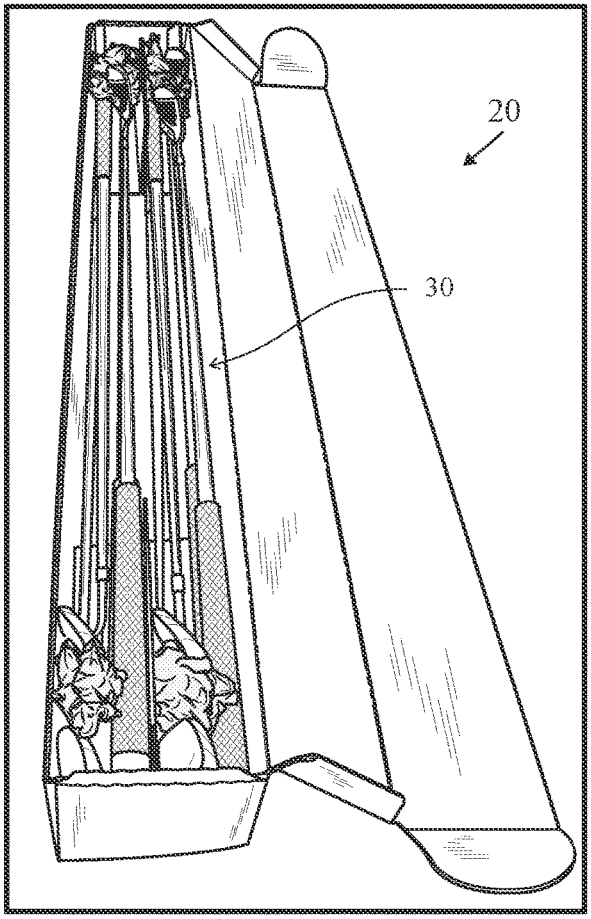
FIG. 1 is a top perspective view of a box with a set of irons placed within it.
Figure 2:
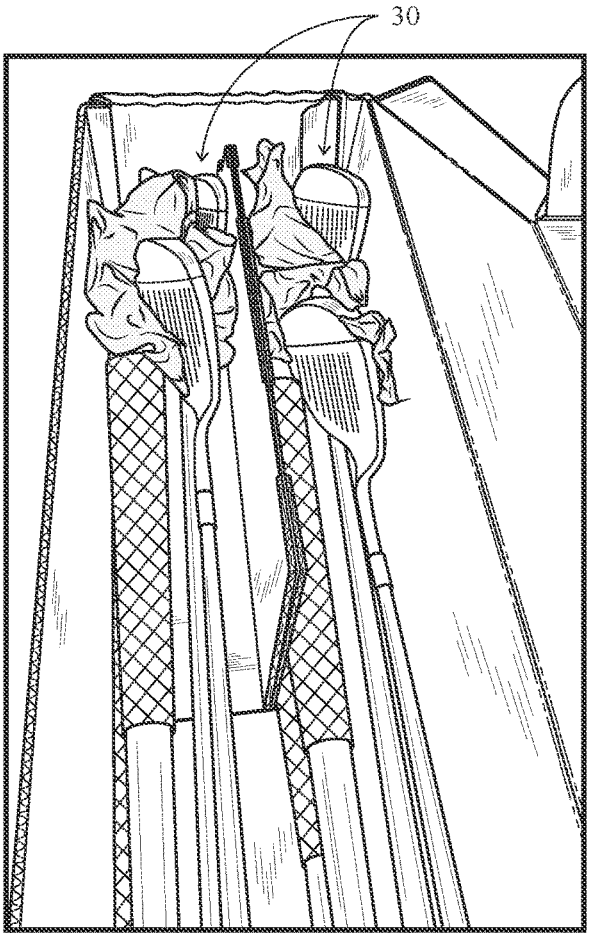
FIG. 2 is a top perspective view of a box with a set of irons placed within it.

A box 20 for packaging set of iron-type golf clubs 30 is shown in FIGS. 1-2. The box is preferably composed of corrugated cardboard preferably having a thickness ranging from 0.1 inch to 0.250 inch.

The box 20 has dividers 10 (separator panels) that allow for secure placement of iron-type golf clubs 30 without the need for each club to be placed within a plastic bag to prevent damage to the clubs 30. Thus, the box 20 of the present invention reduces the amount of plastic used in packaging of sets of iron-type golf clubs 30.

Figure 3:
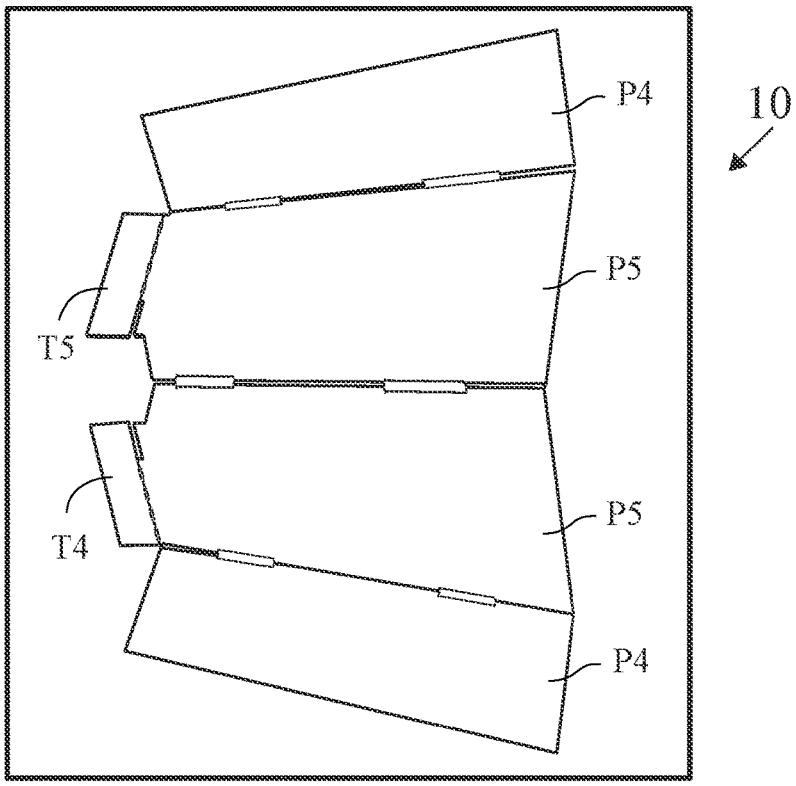
FIG. 3 is an isolated view of a divider insert.

FIG. 3 is an isolated view of a blank for a divider insert 10 for the box 20. The divider insert 10 has a first panel P4, a second panel P5, a third panel P5', a fourth panel P4" and first tab T4 and a second tab T5. The second panel P5 and the third panel P5' are folded to mate with each other while panels P4 and P4' form a base. Tabs T4 and T5 create a slot for the divider insert 10, between the folded tabs T4 and T5 and the folded panels P5 and P5'.

Figure 4:
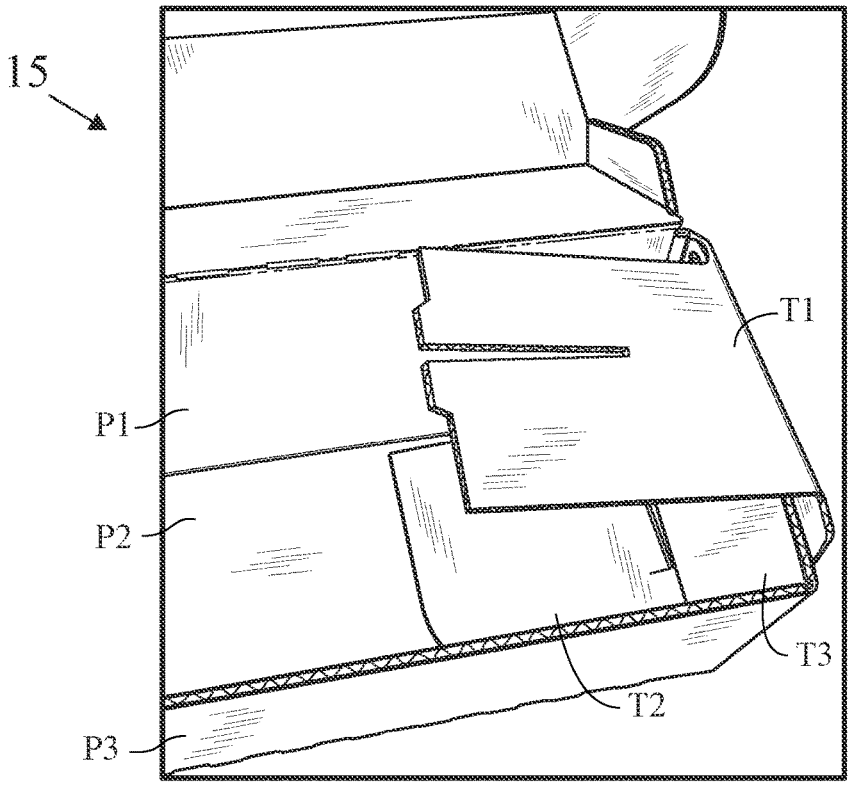
FIG. 4 is an isolated view of one end of the box with a panel having a slot to lock in the divider insert.

FIG. 4 is an isolated view of one end of the box 10 with a tab panel T1 having a slot to lock in the divider insert 10, not shown. The slot of divider insert 10 engages with the slot of tab panel T1 to lock the divider insert 10 in place within the box 20.

Figure 5:
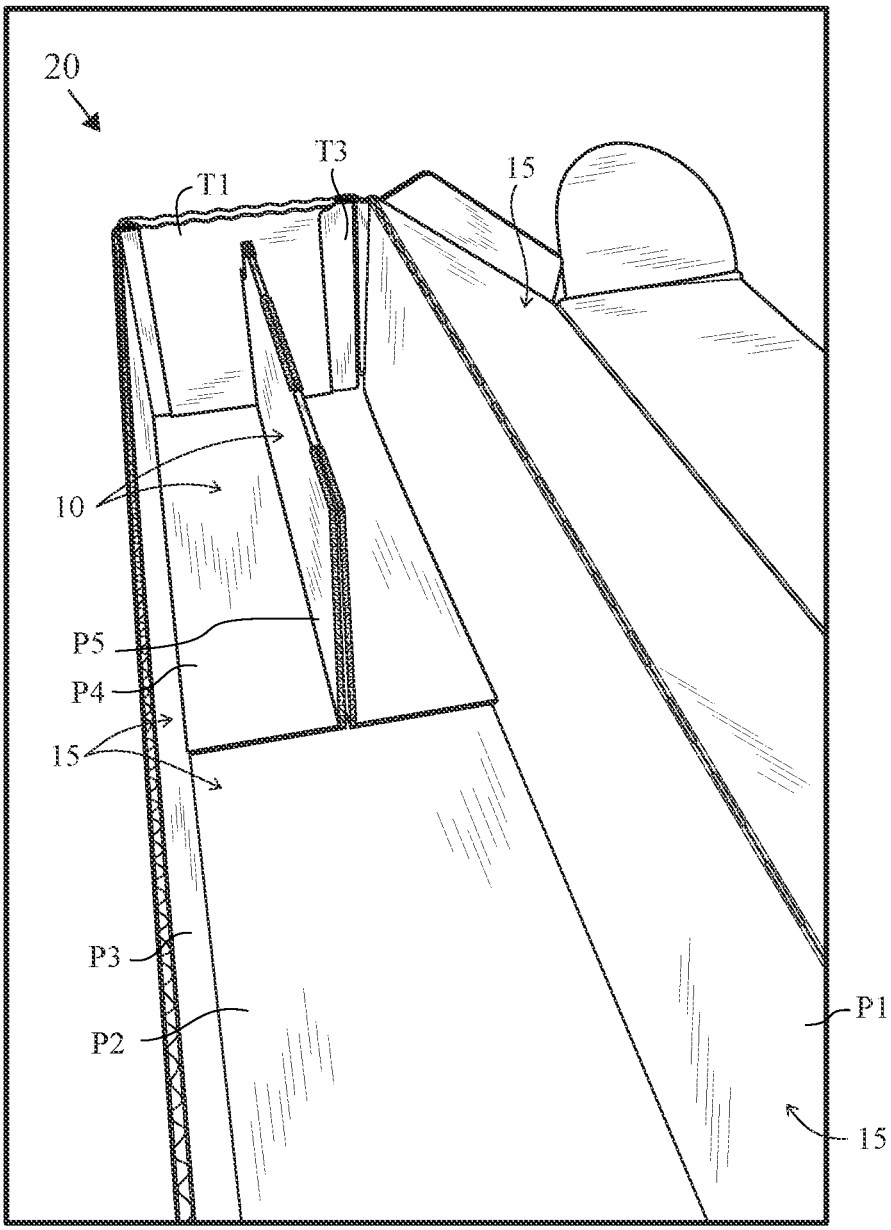
FIG. 5 is a view of an assembled box with a divider.

FIG. 5 illustrates the divider insert 10 placed within the box 20.

Figure 6:
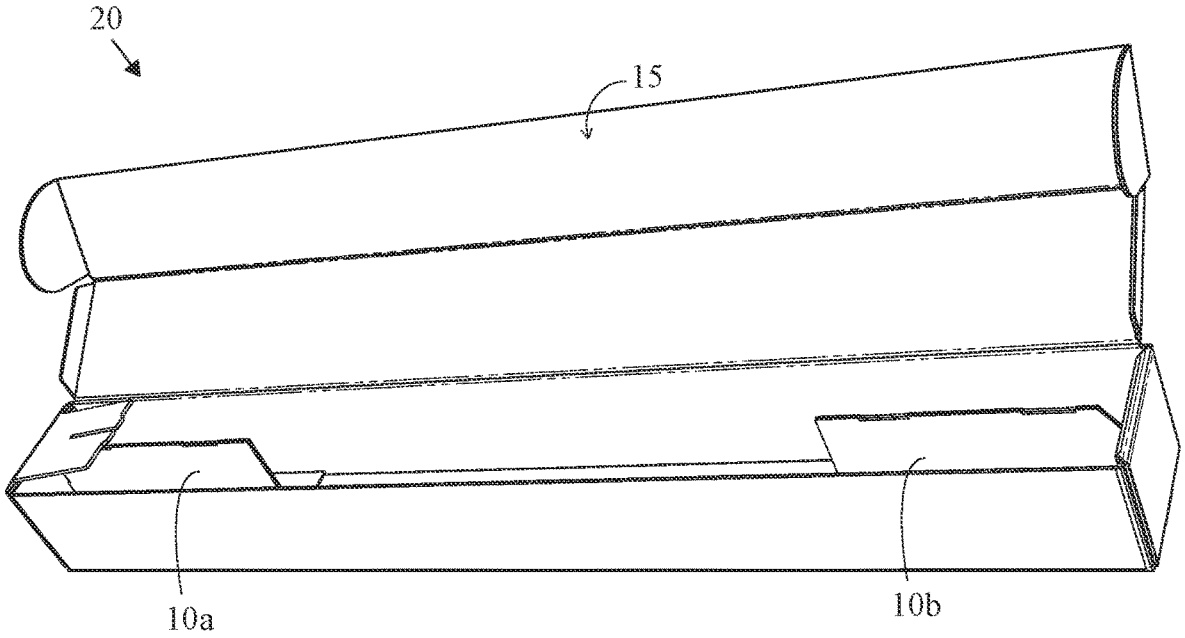
FIG. 6 is an illustration of a box with dividers.

FIG. 6 is a top perspective view of the box 20 showing the divider inserts 10*a* and 10*b* within the main body 15.

Figure 7:
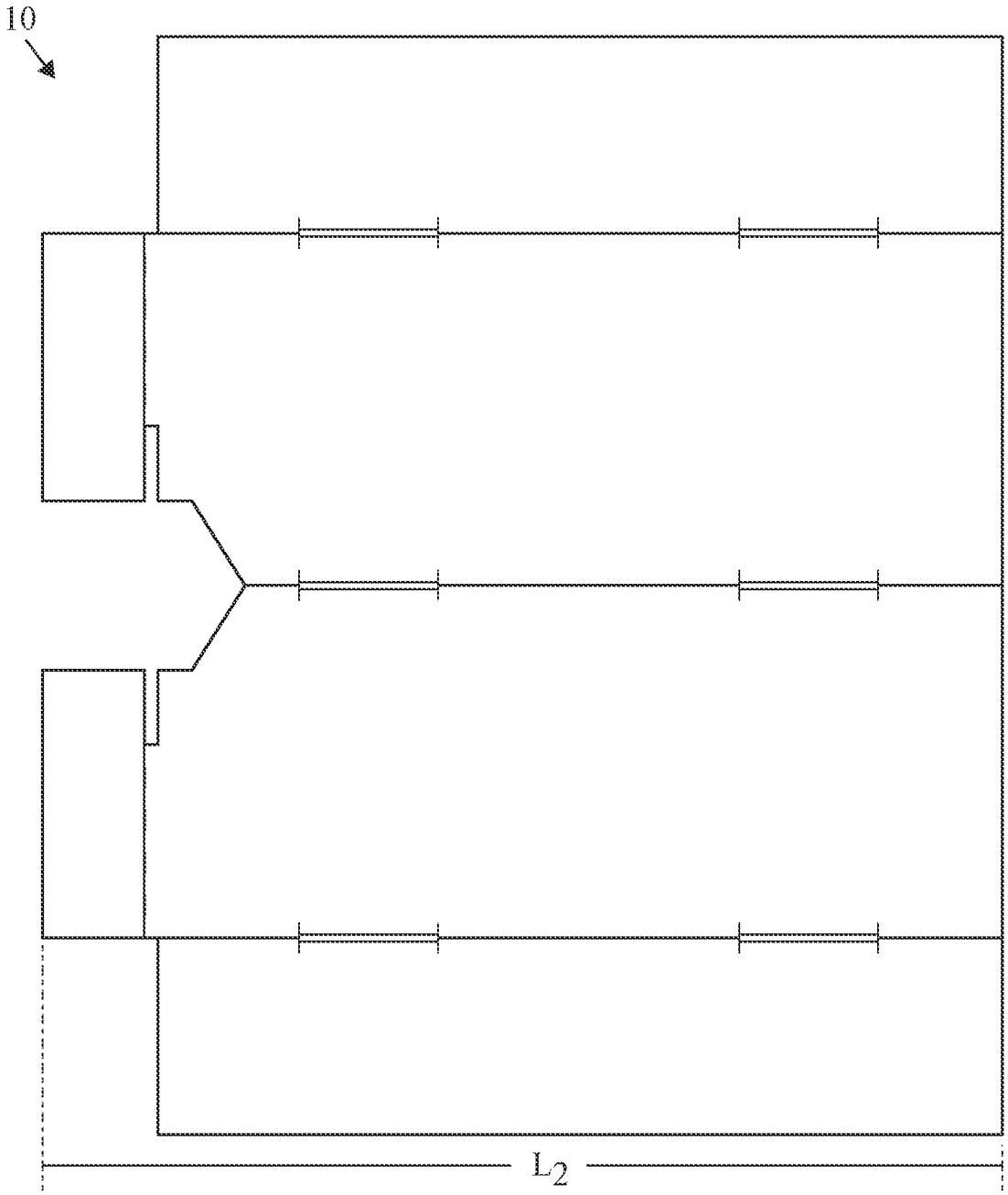
FIG. 7 is a top plan view of a blank for a divider.

FIG. 7 is a top plan view of a blank for a divider insert 10. The divider insert blank 10 preferably has a length L2 preferably ranging from 4 inches to 14 inches, more preferably from 8 inches to 12 inches, and most preferably 11 inches. Panels P5 and P5' of divider insert 10 have a width preferably ranging from 2 inches to 6 inches, more preferably from 3 inches to 5 inches, and most preferably 4.125 inches. Panels P4 and P4' of divider insert 10 have a width preferably ranging from 1 inches to 4 inches, more preferably from 2 inches to 3 inches, and most preferably 2.5 inches. The divider insert blank 10 has a length L3 preferably ranging from 10 to 14 inches, more preferably 12 to 13 inches, and most preferably 12.75 inches.

Figure 8:
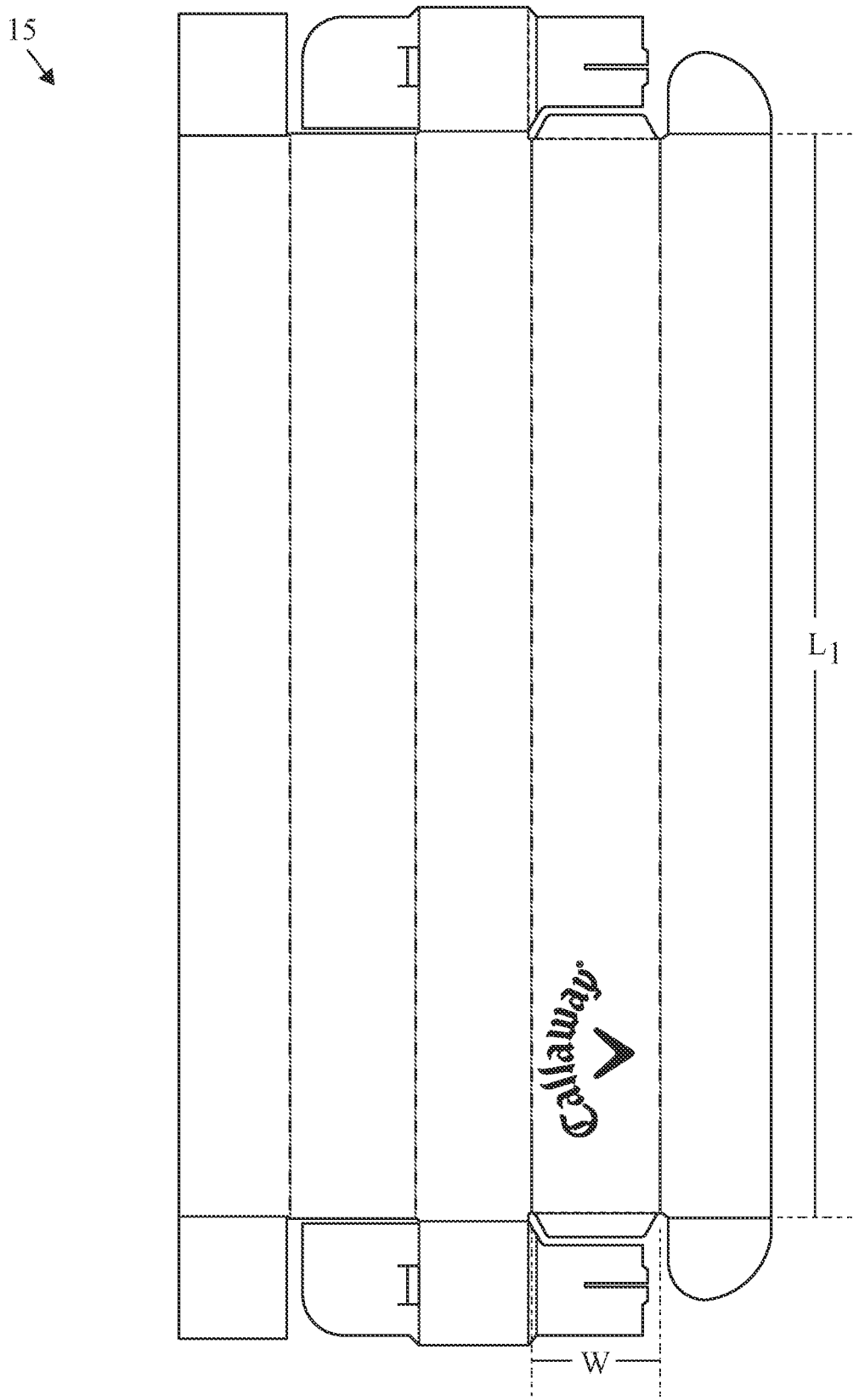
FIG. 8 is a top plan view of a blank for a box.

FIG. 8 is a top plan view of a blank for the main body 15 of box 20. The main body 15 preferably has a length L1 preferably ranging from 30 inches to 55 inches, more preferably from 38 inches to 50 inches, and most preferably 42 inches. Each panel of the main body 15 preferably has a width, W, preferably ranging from 3 inches to 10 inches, more preferably from 4 inches to 6 inches, and most preferably 5 inches. Each tab panel preferably has a length preferably ranging from 2 to 6 inches, and more preferably 3 to 5 inches, and most preferably 4.75 inches.

Figure 9:
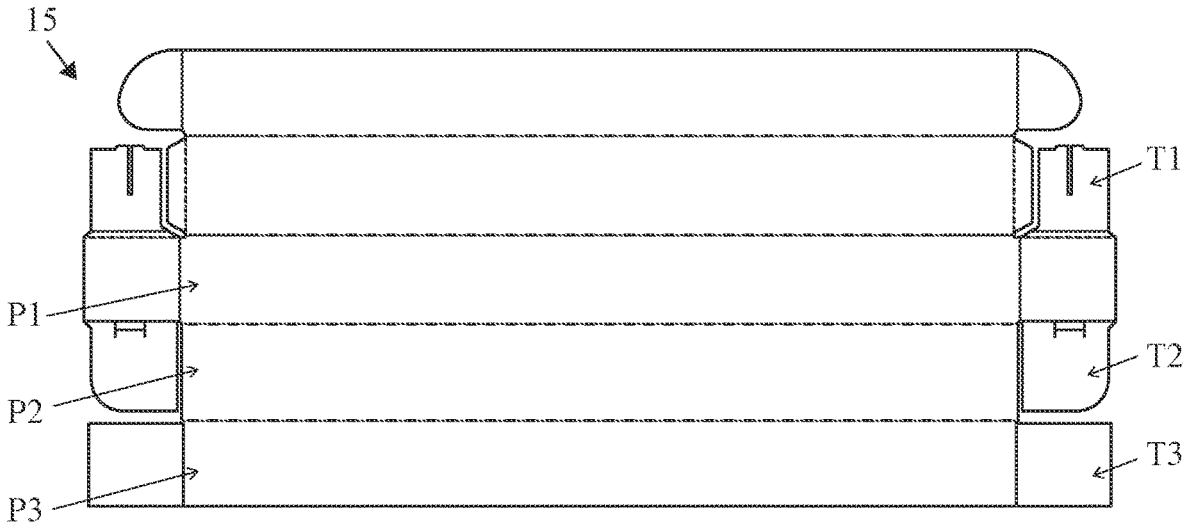
FIG. 9 is a top plan view of a blank for a box.

FIG. 9 is a top plan view of a blank for the main body 15 of box 20. The main body 15 comprises panels P1, P2, P3, P6, and P7, edge panels EP1 and EP2, and tab panels T1, T2, T3, T6, T7, T8, and T9.

Figure 10:
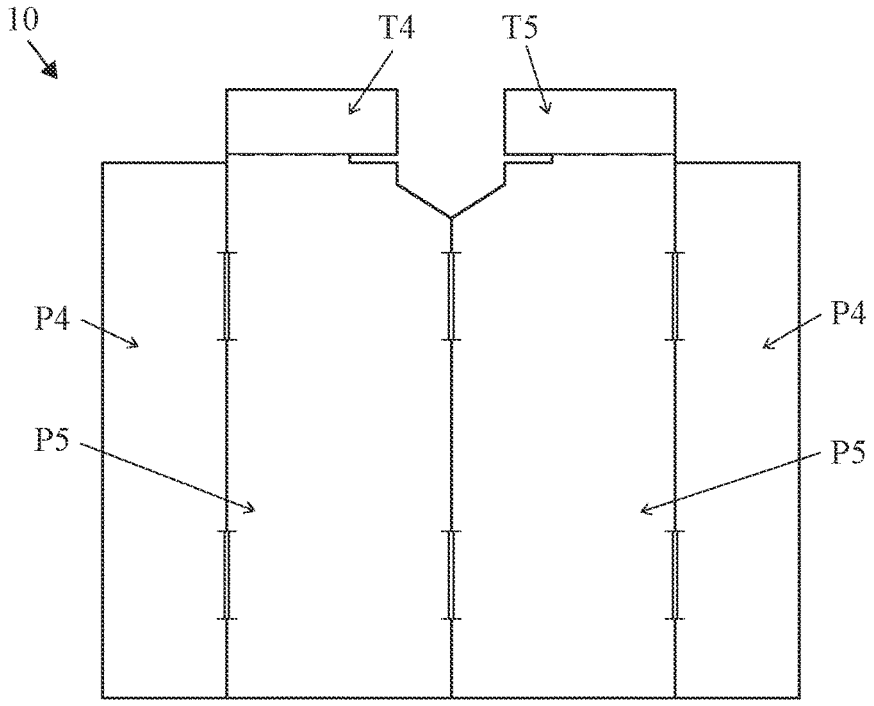
FIG. 10 is a top plan view of a blank for a divider.

FIG. 10 is a top plan view of a blank for a divider insert 10 for the box 20. The divider insert 10 has a first panel P4, a second panel P5, a third panel P5', a fourth panel P4" and first tab T4 and a second tab T5.

Figure 11:
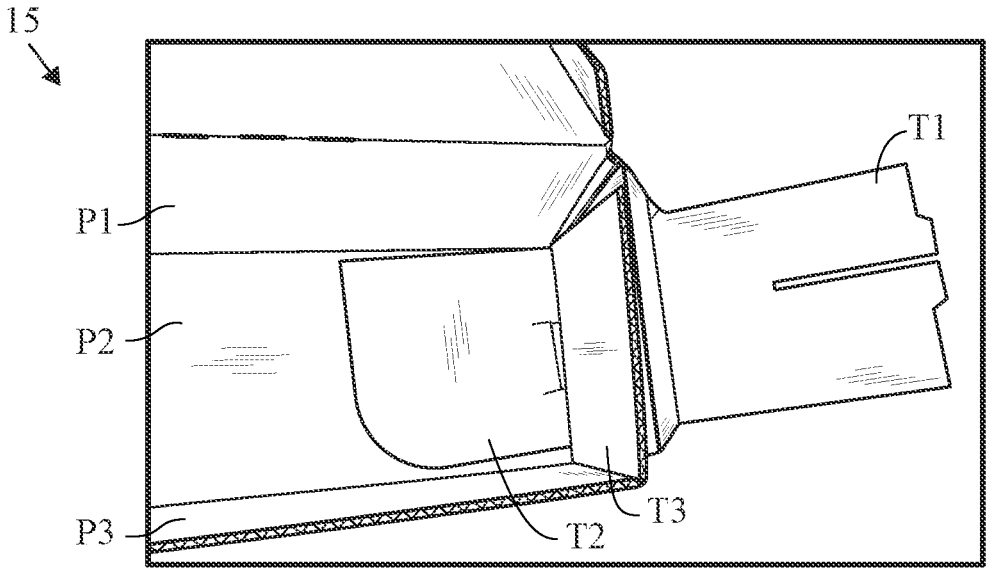
FIG. 11 illustrates an assembly step for the box.

FIG. 11 illustrates an assembly step for the box 20. Panels P3 and P2 are folded up while tab panels T2 and T3 are locked on the inside on both ends of the box 20.

Figure 12:
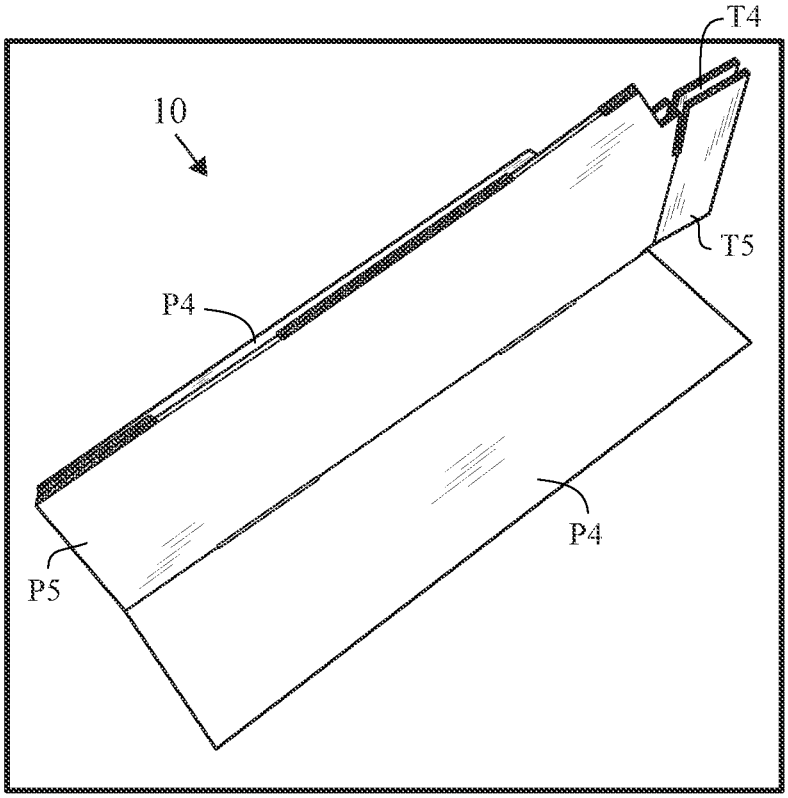
FIG. 12 illustrates an assembly step for the divider.

FIG. 12 illustrates an assembly step for the divider insert 10. Panels P5 and P5' are folded together and panels P4 and P4' are flared outward.

Figure 13:
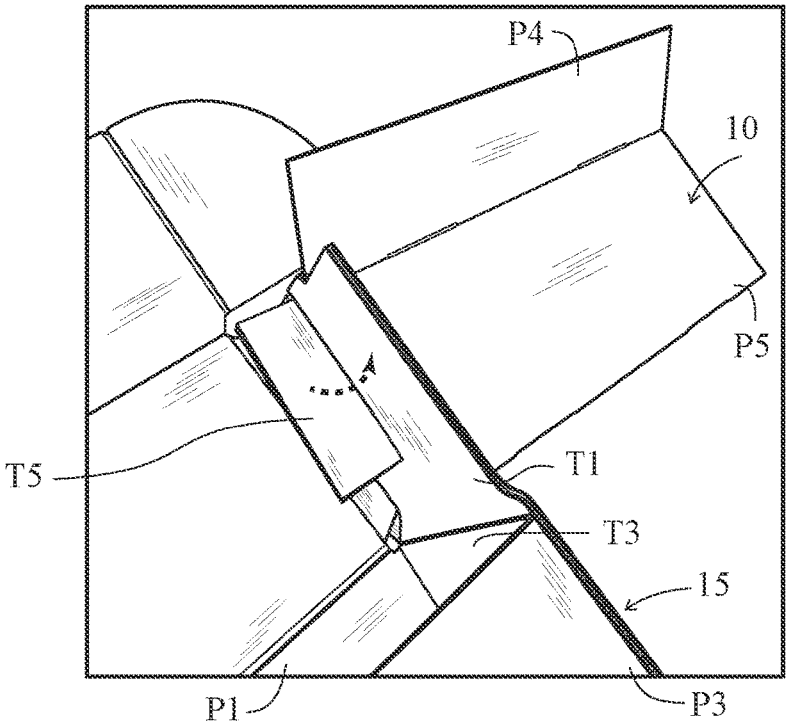
FIG. 13 illustrates an assembly step for inserting the divider within the box.

FIG. 13 illustrates an assembly step for inserting the divider insert 10 within the box 20. The divider insert 10 is positioned within the slot.

Figure 14:
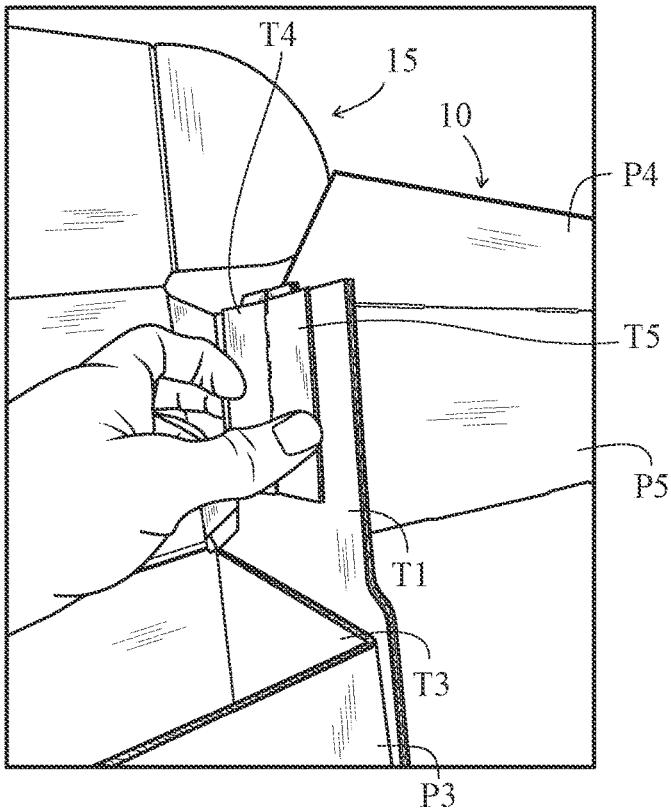
FIG. 14 illustrates an assembly step for inserting the divider within the box.

FIG. 14 illustrates an assembly step for inserting the divider insert 10 within the box 20. The tab panel T5 is flared outward.

Figure 15:
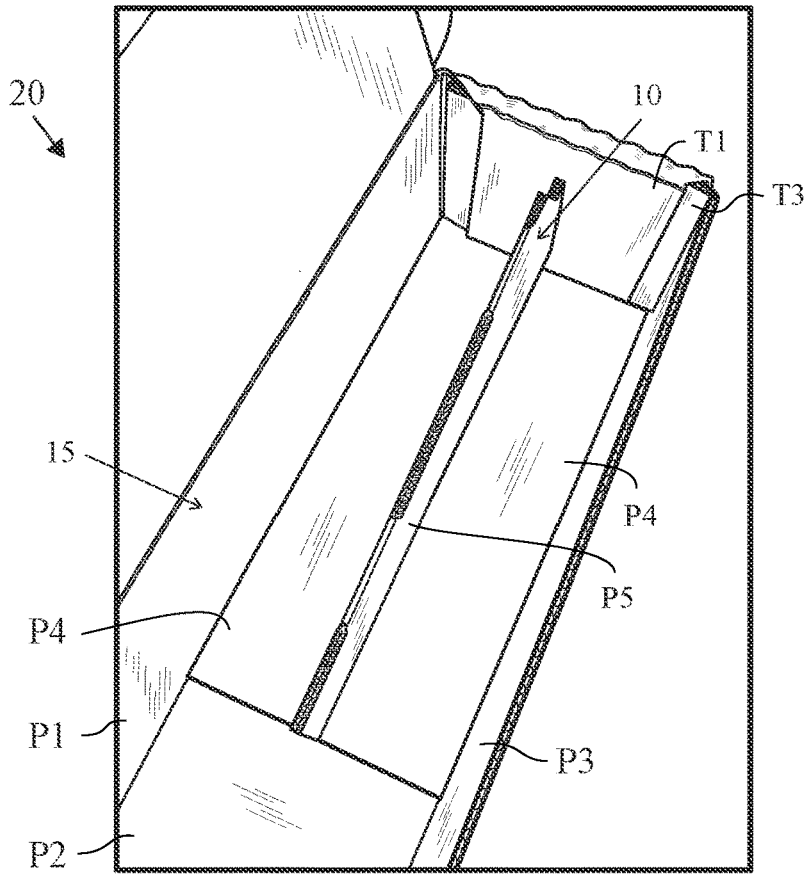
FIG. 15 illustrates an assembly step for inserting the divider within the box.

FIG. 15 illustrates an assembly step for inserting the divider insert 10 within the box 20. The folded divider insert 10 and tab panel T1 are positioned within the box and locked into tab panel T3. The steps are repeated for the other end of the box.

Figure 16:
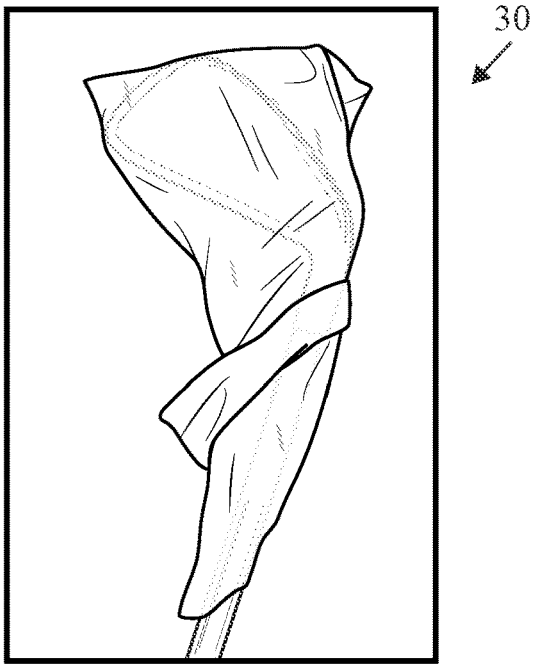
FIG. 16 illustrates a bubble bag placed on a head of an iron-type golf club.
Figure 17:
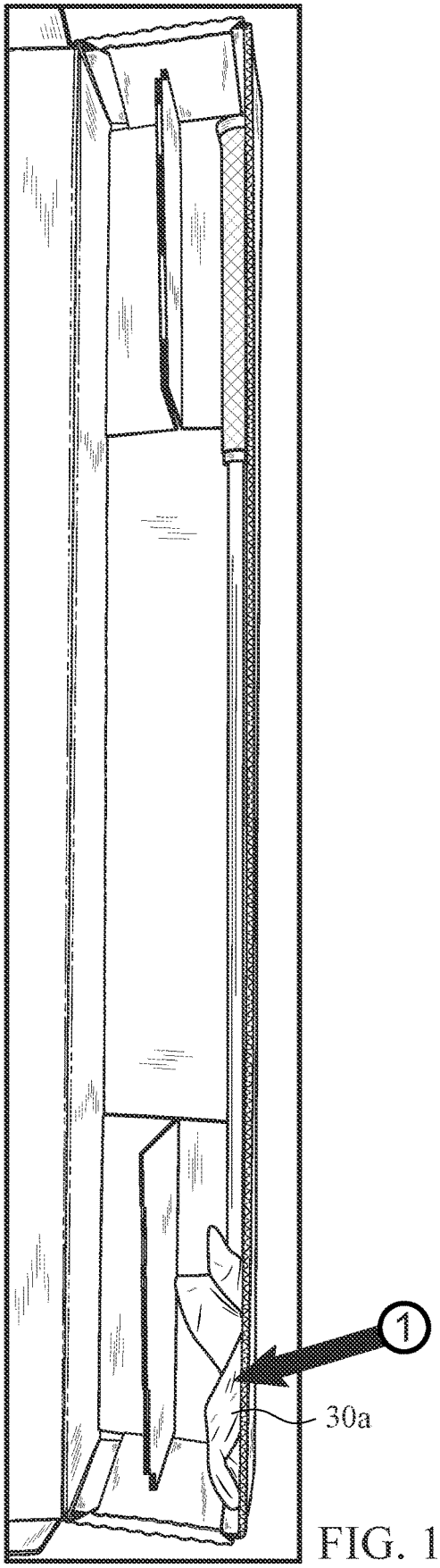
FIG. 17 illustrates an assembled box with a single iron-type golf club positioned within.

FIG. 16 illustrates a bubble bag 30 placed on a head of an iron-type golf club.

Figure 18:
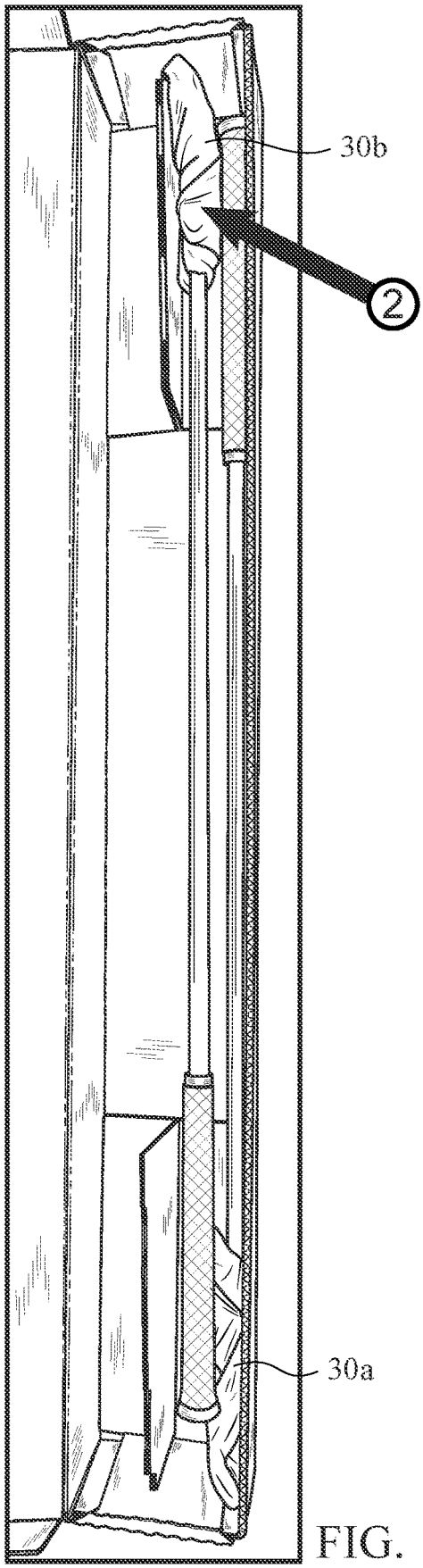
FIG. 18 illustrates an assembled box with two iron-type golf clubs positioned within.
Figure 19:
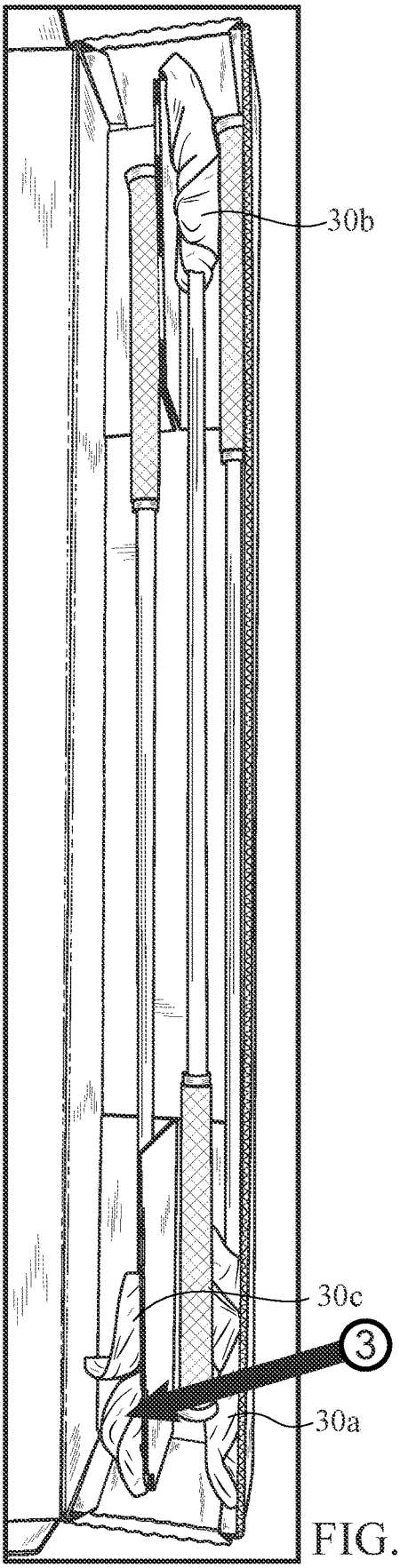
FIG. 19 illustrates an assembled box with three iron-type golf clubs positioned within.
Figure 20:
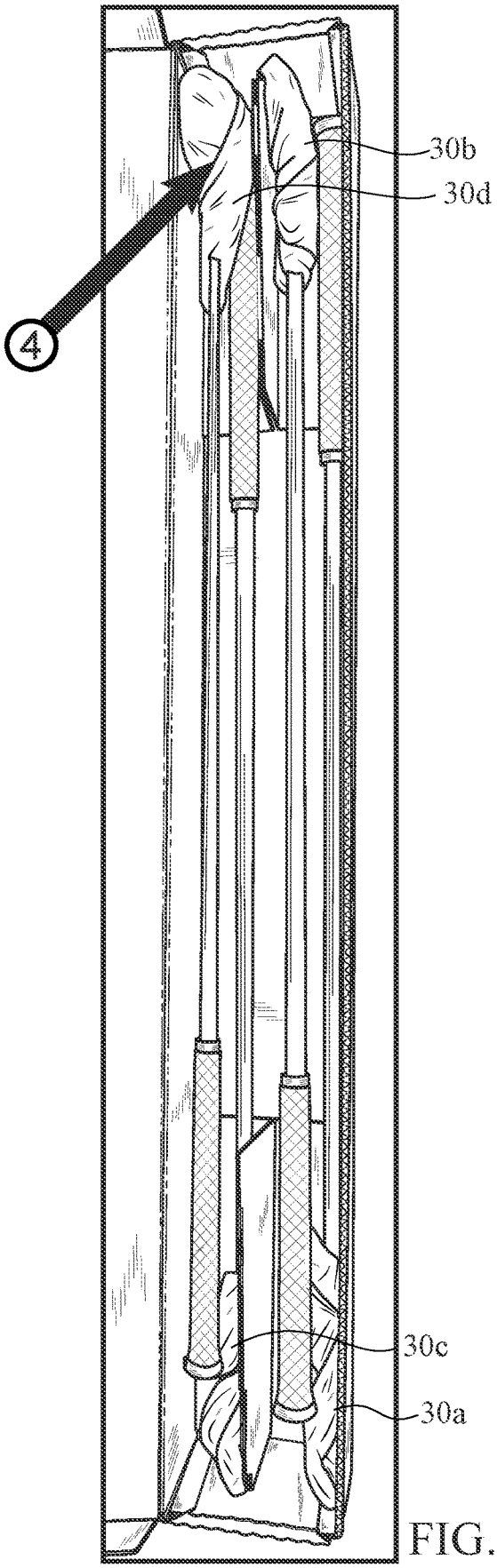
FIG. 20 illustrates an assembled box with four iron-type golf clubs positioned within.
Figure 21:
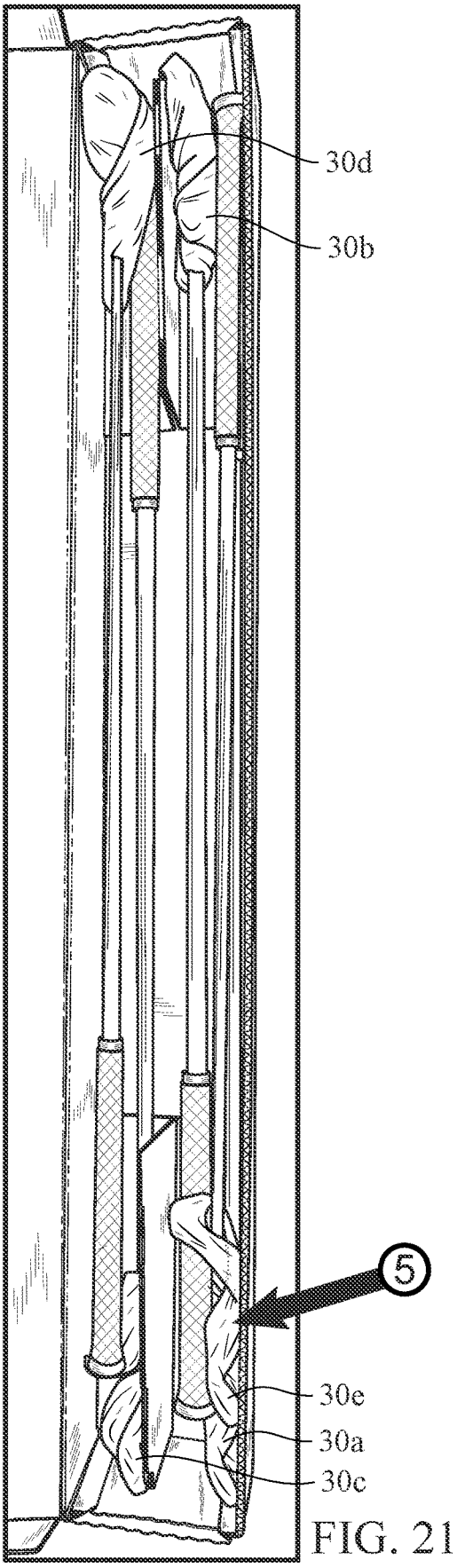
FIG. 21 illustrates an assembled box with five iron-type golf clubs positioned within.
Figure 22:
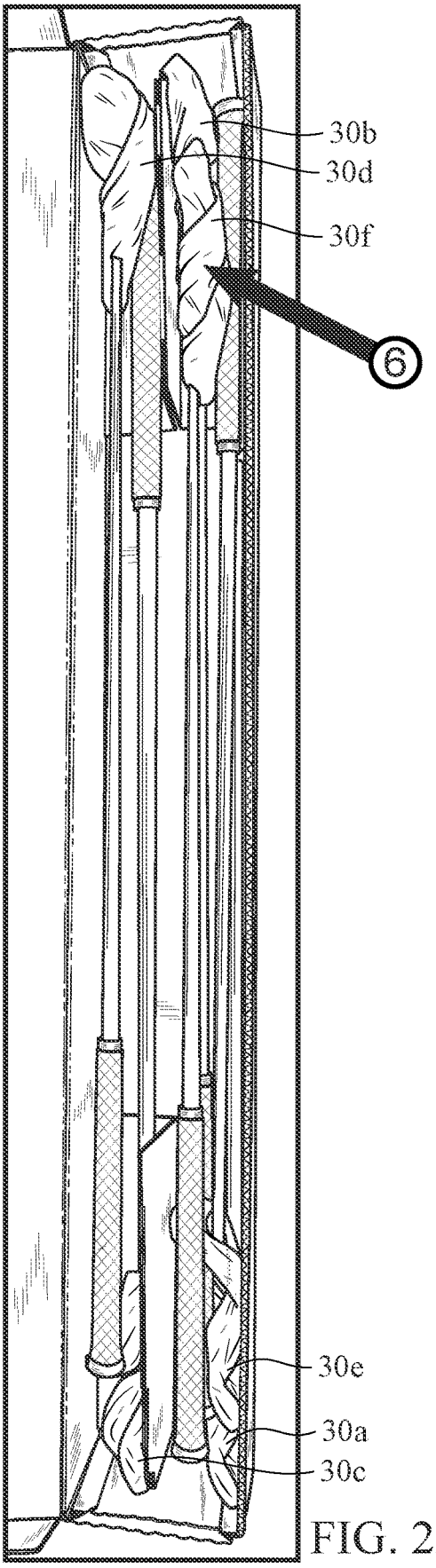
FIG. 22 illustrates an assembled box with six iron-type golf clubs positioned within.
Figure 23:
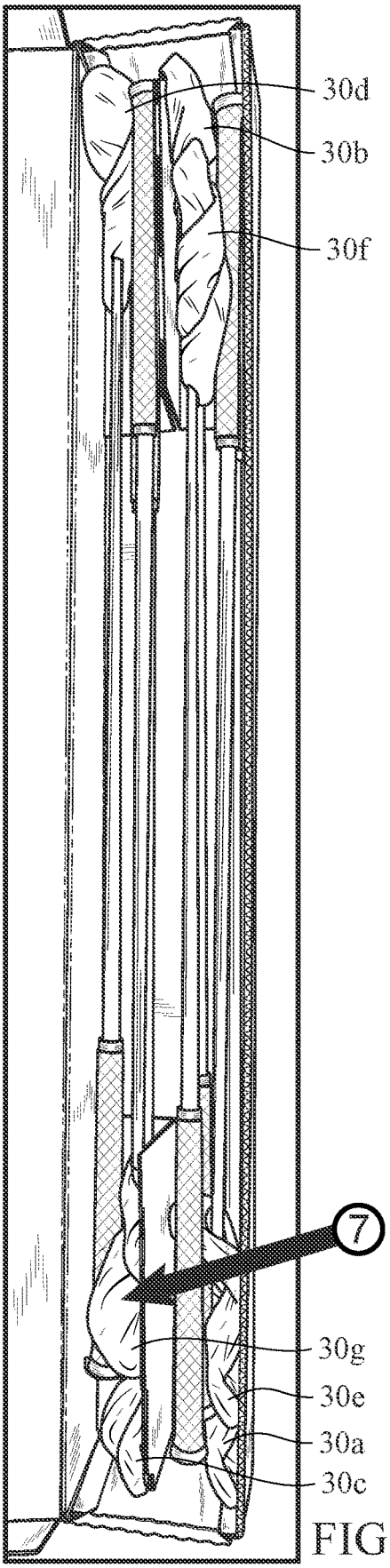
FIG. 23 illustrates an assembled box with seven iron-type golf clubs positioned within.
Figure 24:
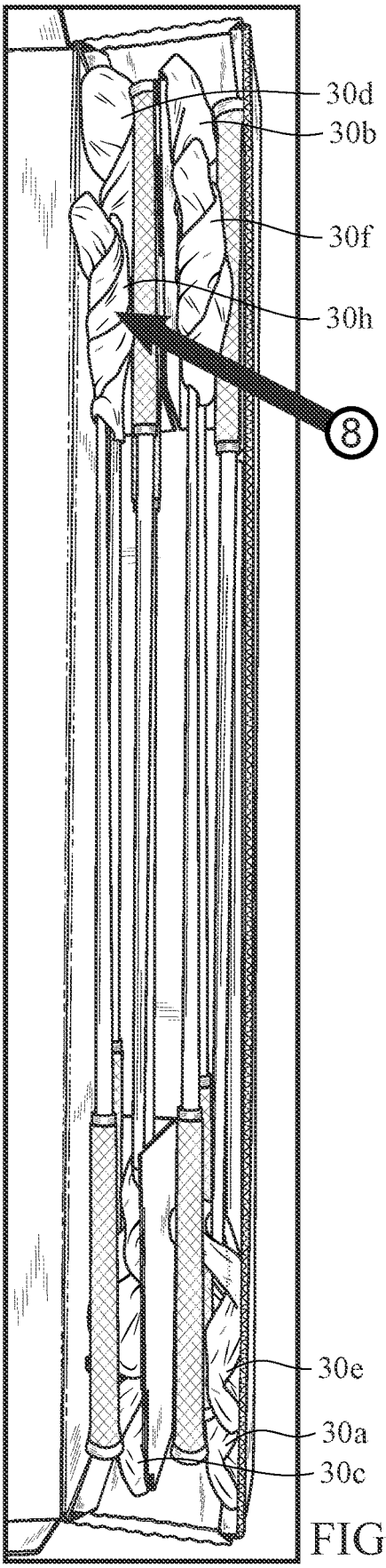
FIG. 24 illustrates an assembled box with eight iron-type golf clubs positioned within.
Figure 25:
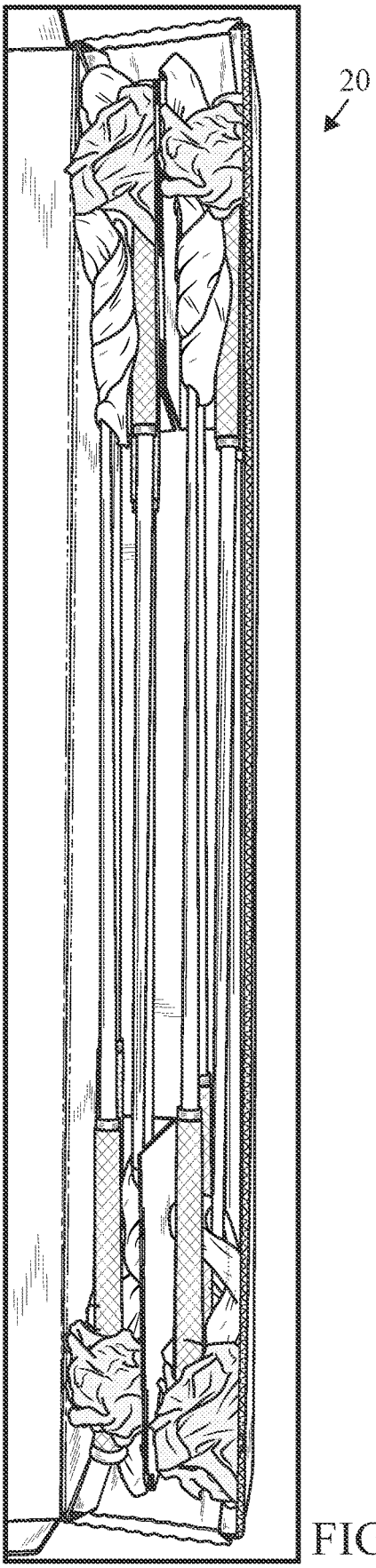
FIG. 25 illustrates a box with a set of iron-type golf clubs ready for closing.
Figure 26:
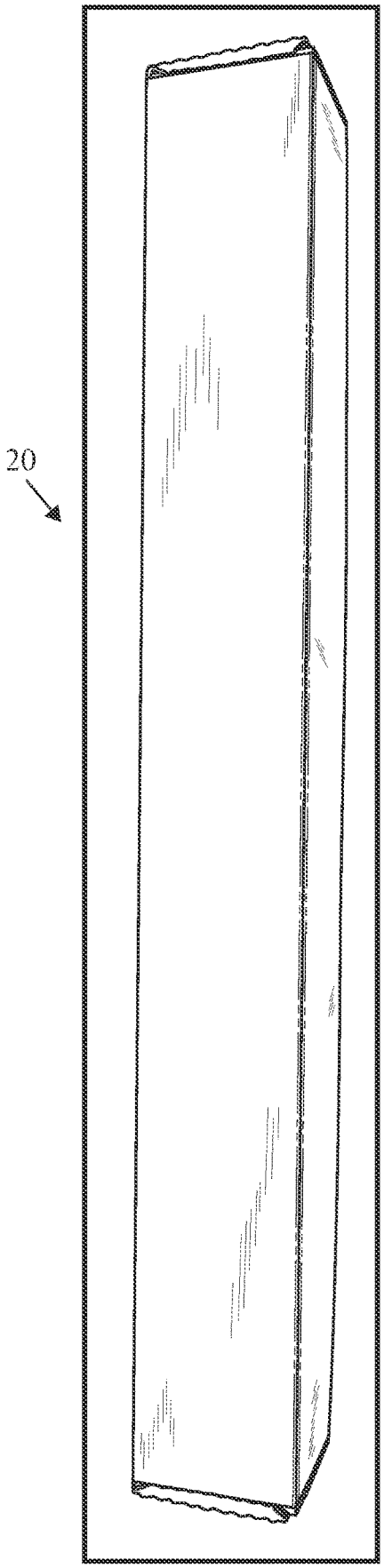
FIG. 26 illustrates a closed box with a set of iron-type golf clubs.

FIGS. 17-26 illustrate the loading of a set of irons into the box 20. The clubs are preferably loaded into the box 20 one at a time, starting with the longest club. All of the clubs are preferably oriented in a "toe up" position. As shown in FIG. 18, a second club 2 is loaded next to the first club 1. Both clubs are on the same side of the divider insert 10. As shown in FIG. 19, a third club 3 is loaded on the other side of the divider insert 10. As shown in FIG. 20, a fourth club 4 is also loaded on the other side of the divider insert 10. As shown in FIG. 21, a fifth club 5 is loaded on the first side of the divider insert 10. As shown in FIG. 22, a sixth club 6 is loaded on the first side of the divider insert 10. As shown in FIG. 23, a seventh club 7 is loaded on the other side of the divider insert 10. As shown in FIG. 24, an eighth club 8 is also loaded on the other side of the divider insert 10. Each of the golf clubs 1-8 have a bubble bag 30*a-h* on the head of the golf club. FIG. 25 shows the golf clubs 1-8 within the box 20. FIG. 26 shows the closed box 20.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A box for a set of iron-type golf clubs, the box comprising:

a body comprising a plurality of walls defining an elongated hollow interior, wherein the plurality of walls comprises side walls, a bottom wall, a front wall, a back wall and a top wall;

a first separator panel extending less than halfway along a long axis of the body from a first end of the body, wherein the first separator panel is removably positioned midway between a width of the elongated hollow interior of body, wherein the first separator panel comprises a first horizontal panel, a first vertical panel, a second vertical panel and a second horizontal panel, the first vertical panel and the second vertical panel parallel and mated to each other, the first vertical panel and the second vertical panel substantially perpendicular to the first horizontal panel and the second horizontal panel, wherein the first horizontal panel and the second horizontal panel are positioned on the bottom wall of the body;

a second separator panel extending less than halfway along a long axis of the body from a second end of the body, the second end opposing the first end, wherein the second separator panel is removably positioned midway between the width of the elongated hollow interior of body, wherein the second separator panel comprises a third horizontal panel, a third vertical panel, a fourth vertical panel and a fourth horizontal panel, the third vertical panel and the fourth vertical panel parallel and mated to each other, the third vertical panel and the fourth vertical panel substantially perpendicular to the third horizontal panel and the fourth horizontal panel, wherein the third horizontal panel and the fourth horizontal panel are positioned on the bottom wall of the body;

wherein a plurality of iron-type golf clubs is positioned within the elongated hollow interior and separated by the first separator panel and the second separator panel;

wherein a width of the box ranges from 3 to 5 inches;

wherein a length of the box ranges from 40 to 60 inches;

wherein a length of each of the first separator panel and the second separator panel ranges 10 inches to 13 inches.

2. The box according to claim 1 wherein plurality of iron-type golf clubs is eight iron-type golf clubs with a club head end of two iron-type golf clubs positioned on a first side of the first separator panel, a club head end of two iron-type golf clubs positioned on a second side of the first separator panel, a club head end of two iron-type golf clubs positioned on a first side of the second separator panel, and a club head end of two iron-type golf clubs positioned on a second side of the second separator panel.

3. The box according to claim 1 wherein the body is composed of corrugated paperboard.

4. A box for a set of iron-type golf clubs, the box comprising:

a body comprising a plurality of walls defining an elongated hollow interior, wherein the plurality of walls comprises side walls, a bottom wall, a front wall, a back wall and a top wall;

a first divider insert extending less than halfway along a long axis of the body from a first end of the body, wherein the first divider insert is removably positioned midway between a width of the elongated hollow interior of body, wherein the first separator panel comprises a first horizontal panel, a first vertical panel, a second vertical panel and a second horizontal panel, the first vertical panel and the second vertical panel parallel and mated to each other, the first vertical panel and the second vertical panel substantially perpendicular to the first horizontal panel and the second horizontal panel, wherein the first horizontal panel and the second horizontal panel are positioned on the bottom wall of the body;

a second divider insert extending less than halfway along a long axis of the body from a second end of the body, the second end opposing the first end, wherein the second divider insert is removably positioned midway between the width of the elongated hollow interior of body, wherein the second separator panel comprises a third horizontal panel, a third vertical panel, a fourth vertical panel and a fourth horizontal panel, the third vertical panel and the fourth vertical panel parallel and mated to each other, the third vertical panel and the fourth vertical panel substantially perpendicular to the third horizontal panel and the fourth horizontal panel, wherein the third horizontal panel and the fourth horizontal panel are positioned on the bottom wall of the body;

wherein a plurality of iron-type golf clubs is positioned within the elongated hollow interior and separated by the first divider insert and the second divider insert;

wherein a width of the box ranges from 3 to 5 inches;

wherein a length of the box ranges from 40 to 60 inches;

wherein a length of each of the first separator panel and the second separator panel ranges 10 inches to 13 inches.

5. The box according to claim 4 wherein plurality of iron-type golf clubs is eight iron-type golf clubs with a club head end of two iron-type golf clubs positioned on a first side of the first divider insert, a club head end of two iron-type golf clubs positioned on a second side of the first divider insert, a club head end of two iron-type golf clubs positioned on a first side of the second divider insert, and a club head end of two iron-type golf clubs positioned on a second side of the second divider insert.

6. The box according to claim 4 wherein the body is composed of corrugated paperboard.

* * * * *